US005524297A

United States Patent [19]

Harrison

[11] Patent Number: 5,524,297

[45] Date of Patent: Jun. 11, 1996

[54] TWO-LEVEL FLUSH VALVE

[76] Inventor: John S. Harrison, 7901 Wishing Well Rd., Las Vegas, Nev. 89123

[21] Appl. No.: 342,746

[22] Filed: Nov. 21, 1994

[51] Int. Cl.[6] ..... E03D 1/14; E03D 1/35

[52] U.S. Cl. ..... 4/325; 4/388; 4/393; 4/394; 4/404

[58] Field of Search ..... 4/324, 325, 379, 4/381, 382, 384, 385, 388, 392, 393, 394, 403, 404

[56] References Cited

U.S. PATENT DOCUMENTS

| | | | |
|---|---|---|---|
| 540,137 | 5/1895 | Blondel | 4/382 |
| 552,538 | 1/1896 | Lewis | 4/388 |
| 1,302,154 | 4/1919 | Griffiths | 4/381 |
| 2,636,184 | 4/1953 | Skutt et al. | 4/324 |
| 2,702,908 | 3/1955 | Thorndike | 4/325 |
| 4,138,749 | 2/1979 | Clark | 4/388 |
| 4,160,294 | 7/1979 | Crumby | 4/324 |
| 4,189,795 | 2/1980 | Conti et al. | 4/324 |
| 4,232,408 | 11/1980 | Chen-Yuan | 4/325 |
| 4,328,596 | 5/1982 | Renz | 4/324 |
| 4,365,364 | 12/1982 | Riedel | 4/378 |
| 4,467,482 | 8/1984 | Dyer | 4/393 |
| 4,937,894 | 7/1990 | Hill, Jr. et al. | 4/324 |
| 5,153,948 | 10/1992 | Smith | 4/415 |
| 5,291,620 | 3/1994 | Gilley | 4/393 X |

*Primary Examiner*—Robert M. Fetsuga

[57] ABSTRACT

The Two-Level Flush Valve retrofits into standard toilet tanks replacing the flush valve and pull cord. Depressing the toilet handle through the usual first resistance lifts a non-buoyant valve (20) open. It is held open by an upper float (28) fastened onto a pull cord (24). When water lowers to the level of upper float (28) the float drops, allowing the valve to close. This accomplishes a short-duration flush that clears liquid waste from the toilet bowl and saves about a half tank of water. Depressing the handle through a second resistance causes valve (20) to pull a carriage (32) up and out of a latch (52). Lower floats (40) on carriage (32) hold valve (20) open until the tank is almost empty. This accomplishes a full flush that ensures that solid waste is flushed out without leaving dirty water in the toilet bowl. A valve delayer (62) holds valve (20) slightly open for a few seconds to allow complete refilling of the toilet bowl. Valve delayer (62) consist of water chamber (68) that compresses from the weight of the valve (20). A small expulsion hole (76) in chamber (68) limits the rate that water exits and thus limits the speed of the closing of valve (20). The present invention is completely adjustable. Alternate variations include several types of simple, dependable latches (52); a one-piece valve and carriage; and dual flush handles.

12 Claims, 8 Drawing Sheets

TWO-LEVEL FLUSH VALVE

BACKGROUND

1. Field of Invention

This invention relates to toilet flush tanks, more specifically, it is a simple two-level valve that retrofits into existing tanks to reduce water usage.

2. Background and Description of Prior Art

Expanding cities, ecological concerns, and reoccurring droughts have increased the need for water conservation. Flush-tank toilets are a major water user, accounting for about 38% of indoor residential water use. In response to this the federal government has recently required all new toilets to use no more than 1.6 gallons per flush. This has been accomplished by redesigning the toilet bowl and siphon. But this has done nothing to help the millions of 3.5 and 5.5 gallon toilets now in use. The cost of replacing them with new toilets is too discouraging to most owners. The savings in water bills only pays for the cost of replacement where water rates are extremely high, and then it takes 20 to 30 years. A device is needed that retrofits into existing toilets to make them comparable in water usage to the new toilets.

Some past devices have reduced the depth of water in the tank. This has reduced the pressure head at the bottom of the tank which reduces the velocity of the water flowing into the toilet bowl. The velocity is needed to carry waste out of the bowl through the siphon. Consequently, these devices cannot reduce the depth of water in the tank very much, before the flush becomes ineffective.

Other devices such as U.S. Pat. No. 4,467,482 (Dyer, Aug. 28, 1984) and U.S. Pat. No. 5,153,948 (Smith et al., Oct. 13, 1992) use a full tank., but close the valve early to make a short-duration flush. When set at the optimum level, these devices can flush out liquid waste and toilet paper with just over 1.6 gallons of water. They can often flush out solid waste at that level too. But unless they are set to higher levels, they leave dirty water in the bowl and din on the sides of the bowl. This results in a water wasting second flush. Also, waste sometimes gets trapped in the bowl side of the siphon just out of sight. And once in a while, pesky, extra buoyant pieces of waste require all the water in the tank to flush them out. Another problem is that these devices do not allow the toilet bowl to refill completely. More water in the bowl helps in the next flush to start the water moving quicker.

Because of the above problems early-closing valves are not common place. A two-level system that uses a short duration flush for liquids and a longer flush for solids can be more successful. Numerous systems that do this have been patented. Unfortunately, very few of them have reached the stores and none have caught on and found success with the public. An examination of them shows why.

These two-level systems commonly use complex mechanisms such as large siphons in the tank, water spray pushing the valve shut, hydraulic pistons, electrical controls, barriers dividing the tank into compartments, or valves at different levels. They are much too complicated for such a simple function. They require new openings in the tank, supports some how fastened to the tank, special control knobs, and a trained technician to install them. Many are large and bulky. Some won't actually fit inside the tank. Packaging and shipping are expensive and they cannot be attractively displayed in the stores.

Other two-level systems claim to be simpler. They usually use a mechanism that knocks the valve shut early or a valve that opens only part way so that the current closes it. Although somewhat simpler they still need intricate methods to control when the valve closes. They still do not compete with the simplicity and economy of the common flapper valve. Most buyers are not ecologically minded enough to buy something where they do not clearly see a quick financial saving. Also, because these inventions use a number of moving parts, they have a greater chance of wearing out or malfunctioning than does the flapper valve. Buyers want something dependable that they can install and forget about.

Some two-level systems such as U.S. Pat. No. 2,636,184 (Skutt, et. al., Feb. 12, 1951) and U.S. Pat. No. 4,365,364 (Riedel, Dec. 28, 1982) are simple and economical but are completely manual. Users must judge how long to hold down the flush handle by counting seconds or observing the contents of the toilet bowl. This is hard for children to learn and users do not want to give up the easiness of the usual way of flushing a toilet.

U.S. Pat. No. 4,937,894 (Hill, et. al., Jul. 3, 1990), U.S. Pat. No. 4,160,294 (Crumby, Jul. 10, 1979), and U.S. Pat. No. 4,328,596 (Renz, May 11, 1982) have some similarities to the present invention. Serious oversights in their design have made each of them inoperative.

All of the above two-level inventions suffer the same problem as the one level ones that close the valve early. The bowl is refilled from the same ball cock that refills the tank. Since it takes less time to refill a half-empty tank there is not enough time to refill the bowl completely. This diminishes the effectiveness of the next flush and annoys users. Users think their toilet is not working well if the bowl does not fill up like it used to.

OBJECTIVES AND ADVANTAGES

Accordingly, the objectives and advantages of the present invention are:

a) to greatly reduce water consumption in toilets by providing an adjustable, short-duration flush that flushes out liquid waste.

b) to allow a longer, adjustable flush that clears out all solid waste and leaves a clean toilet bowl.

c) to provide complete refill of the toilet bowl.

d) to provide a flushing device that retrofits into most toilets now in use.

e) to allow quick installation without any special skills, knowledge, or tools.

f) to provide a device that is small for easy packaging, shipping, and attractive displaying in stores.

g) to provide a device that is very inexpensive.

h) to provide a device that is durable and dependable, unlikely to leak or malfunction.

i) to allow easy operation by the user, requiring only one simple movement of the flush handle.

j) to provide a classy variation for that segment of the population which enjoys spending more than saving.

Further objectives and advantages of my invention will become apparent from a consideration of the drawings and ensuing description.

DRAWING FIGURES

Figure 1:
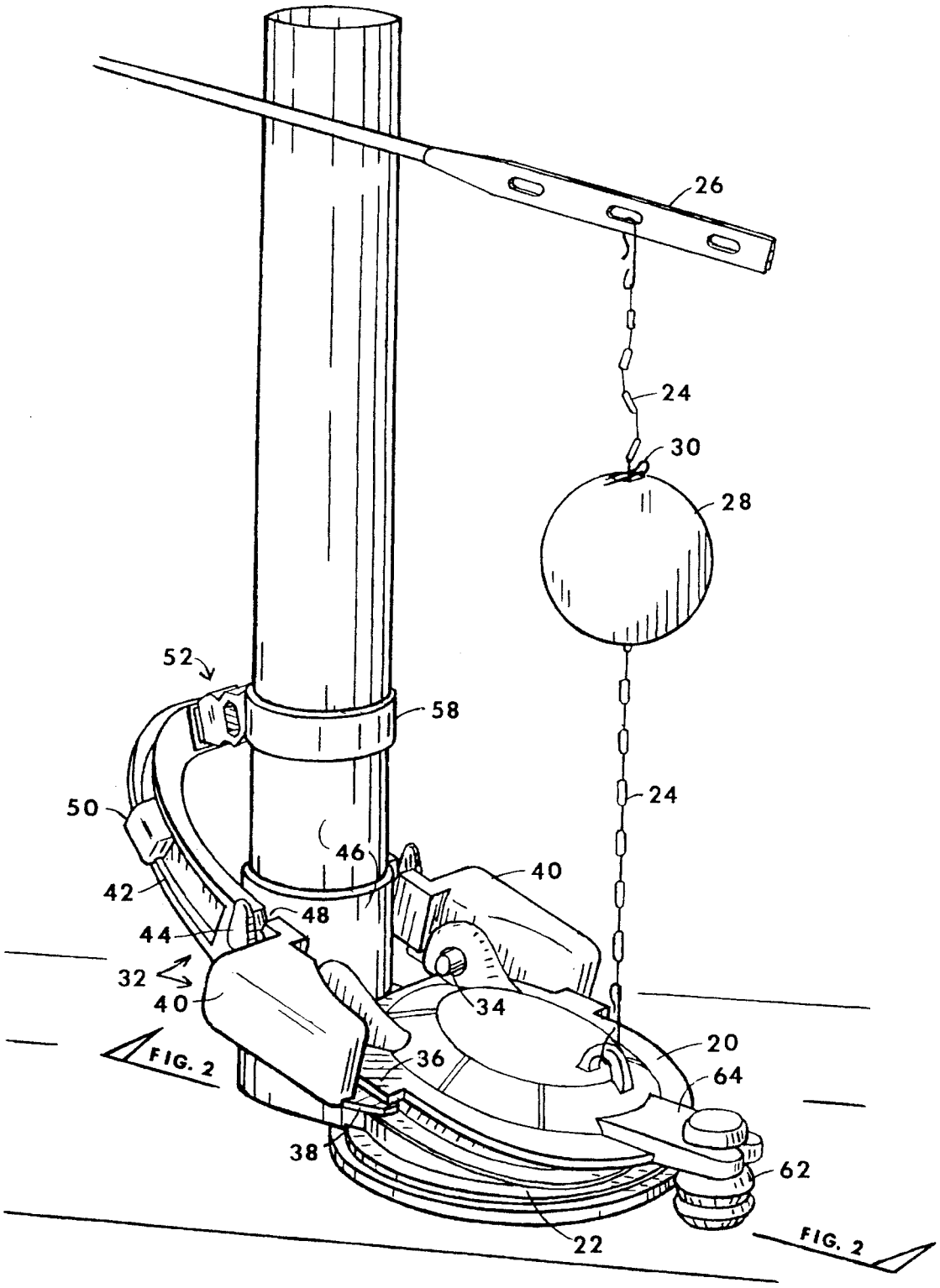
FIG. 1 shows a three dimensional view of the preferred embodiment.

| Reference Numerals in Drawings | |
|---|---|
| 20 Valve | 58 Cincture |
| 22 Outlet | 60 Flexible Connection |
| 24 First Pull Cord | 62 Valve Delayer |
| 26 First Lift Arm | 64 Clevis |
| 28 Upper Float | 66 Bellows |
| 30 Clip | 68 Chamber |
| 32 Carriage | 70 Intake Opening |
| 34 Pins | 72 Rim |
| 36 Tabs (Valve) | 74 Tank Bottom |
| 38 Tabs (Carriage) | 76 Expulsion Hole |
| 40 Lower Floats | 78 Air Chamber |
| 42 Frame | 80 Opening |
| 44 Mounting Pins | 82 Release Hole |
| 46 Overflow Tube | 84 Adjustment Band |
| 48 Slots | 86 Adjustment Hole |
| 50 Weights | 88 Spring Latch |
| 52 Latch | 90 Spring |
| 54 Magnet | 92 Screw |
| 56 Contact Plate | 94 Slotted Screw Hole |
| 96 Spurs | 128 Adjustment Band |
| 98 Projecting End | 130 Adjustment Hole |
| 100 Suction Cup Latch | 132 Slit |
| 102 Valve Delayer | 134 Vacuum Type Delay |
| 104 Suction Cup | 136 Vacuum Cup |
| 106 Flat Surface | 138 Stem Opening |
| 108 All Rubber Latch | 140 Outlet Openings |
| 110 Projecting Finger | 142 Suction Hole |
| 112 Keeper | 144 Hinge |
| 114 Flexible Neck | 146 Float Opening |
| 116 Stop | 148 Dual Handle System |
| 118 Cinch Wire | 150 Inserts |
| 120 Cup-Type Delayer | 152 First Handle |
| 122 Cup | 154 Second Handle |
| 124 Plunger | 156 Second Lift Arm |
| 126 Stem | 158 Second Pull Cord |

DESCRIPTION OF THE PREFERRED EMBODIMENT

Figure 2:
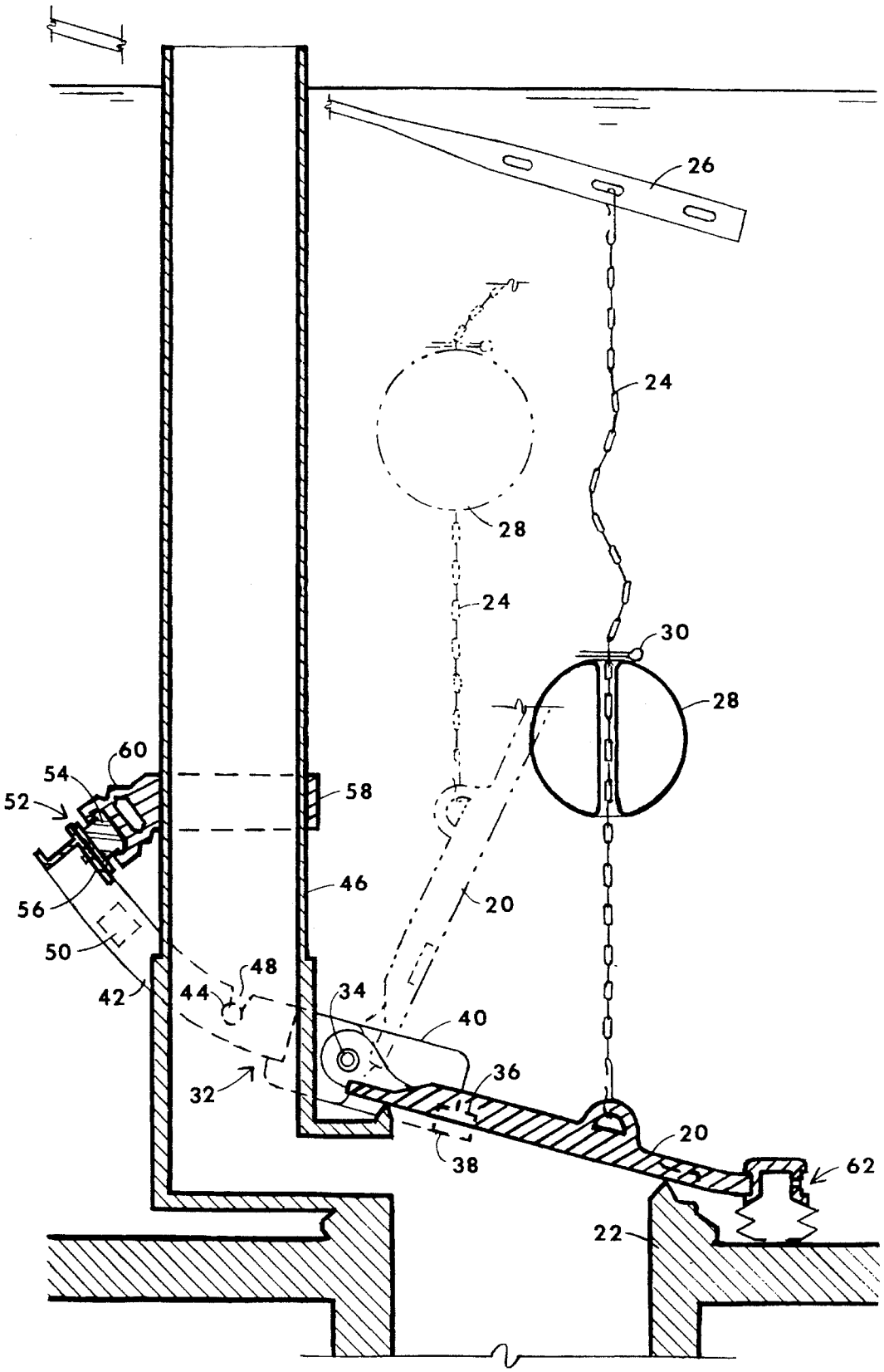
FIG. 2 is a section through the preferred embodiment with the carriage in the first position.
Figure 3:
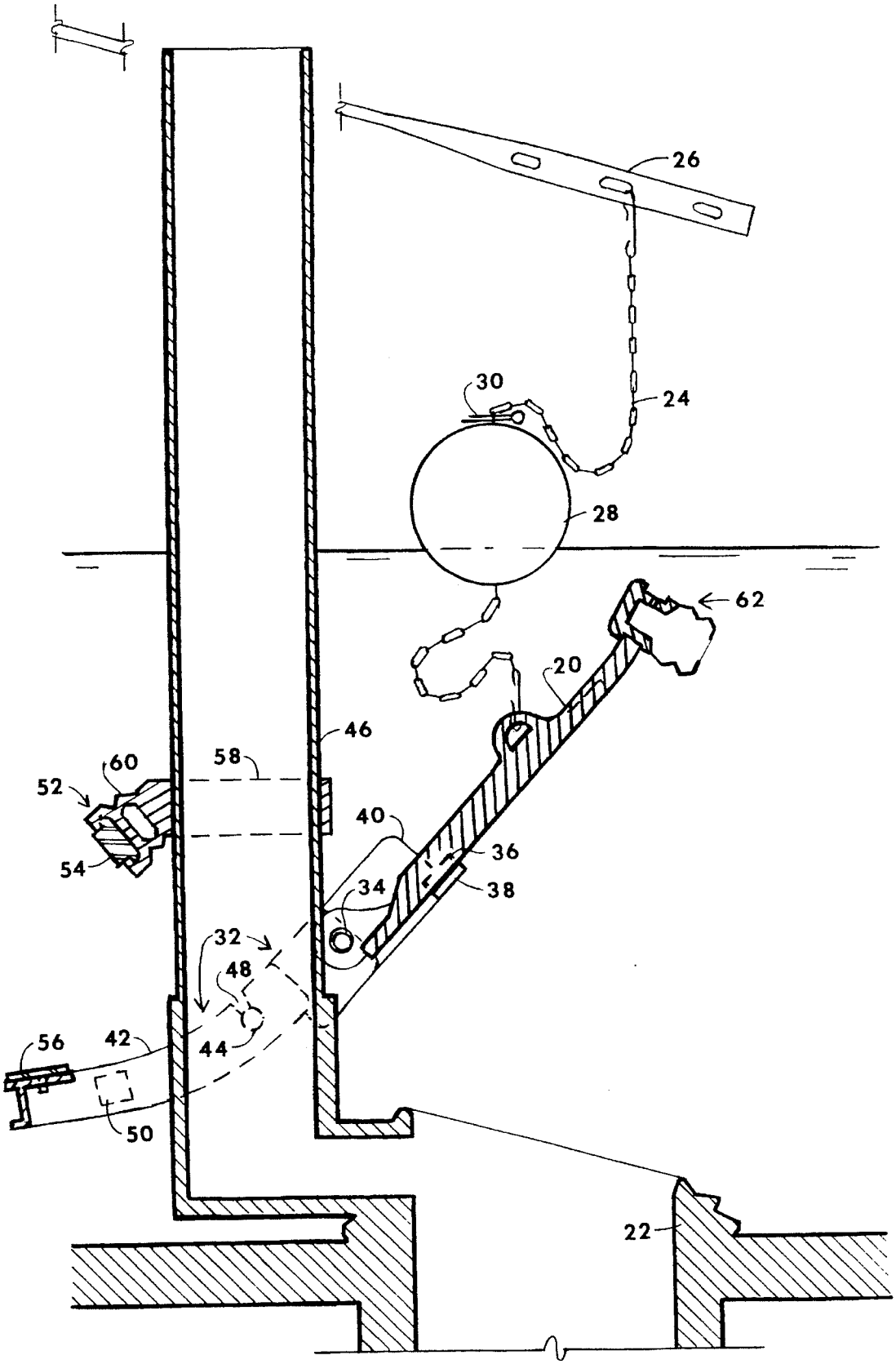
FIG. 3 is a section through the preferred embodiment with the carriage in the second position.

FIGS. 1, 2, & 3 show a preferred embodiment of the present invention. A non-buoyant valve 20 of flexible material such as rubber or vinyl seats on a conventional outlet 22 of a toilet flush tank. It is connected to a first chain or pull cord 24 which is connected to a typical first lift arm 26. First lift arm 26 is fastened to a conventional flush handle (not shown) of a flush tank. An upper float 28 is attached to first pull cord 24 with a twist wire or clip 30, so that the height of the upper float 28 can be adjusted. Upper float 28 is made of hollow plastic or foam plastic.

Valve 20 is rotatably attached to a carriage 32 by pins 34. Tabs 36 on valve 20 align with tabs 38 on carriage 32 to support valve 20 so that it can not rotate below carriage. Carriage 32 is comprised of lower floats 40 attached to a plastic frame 42. Lower floats 40 are made of foam plastic (not shown) or hollow plastic formed integral with frame 42. Carriage 32 is rotatably attached on the usual mounting pins 44 of a conventional overflow tube 46. Slots 48 allow easy, snap-on mounting. Carriage 32 rotates between a first position shown in FIGS. 1 & 2, and a second position show in FIG. 3. Small weights 50 for adjustment may be attached at different positions along frame 42.

A latch 52 holds carriage 32 in first position. It is comprised of a magnet 54 made of non-corrosive metal such as stainless steel and a non-corrosive contact plate 56. Magnet 54 is fastened to an overflow tube 46 by a cincture 58 and flexible connection 60. Cincture 58 can be raised or lowered on overflow tube 46 to adjust for different slopes of outlet 22. Contact plate 56 is connected to frame 42 of carriage 32.

Figure 4:
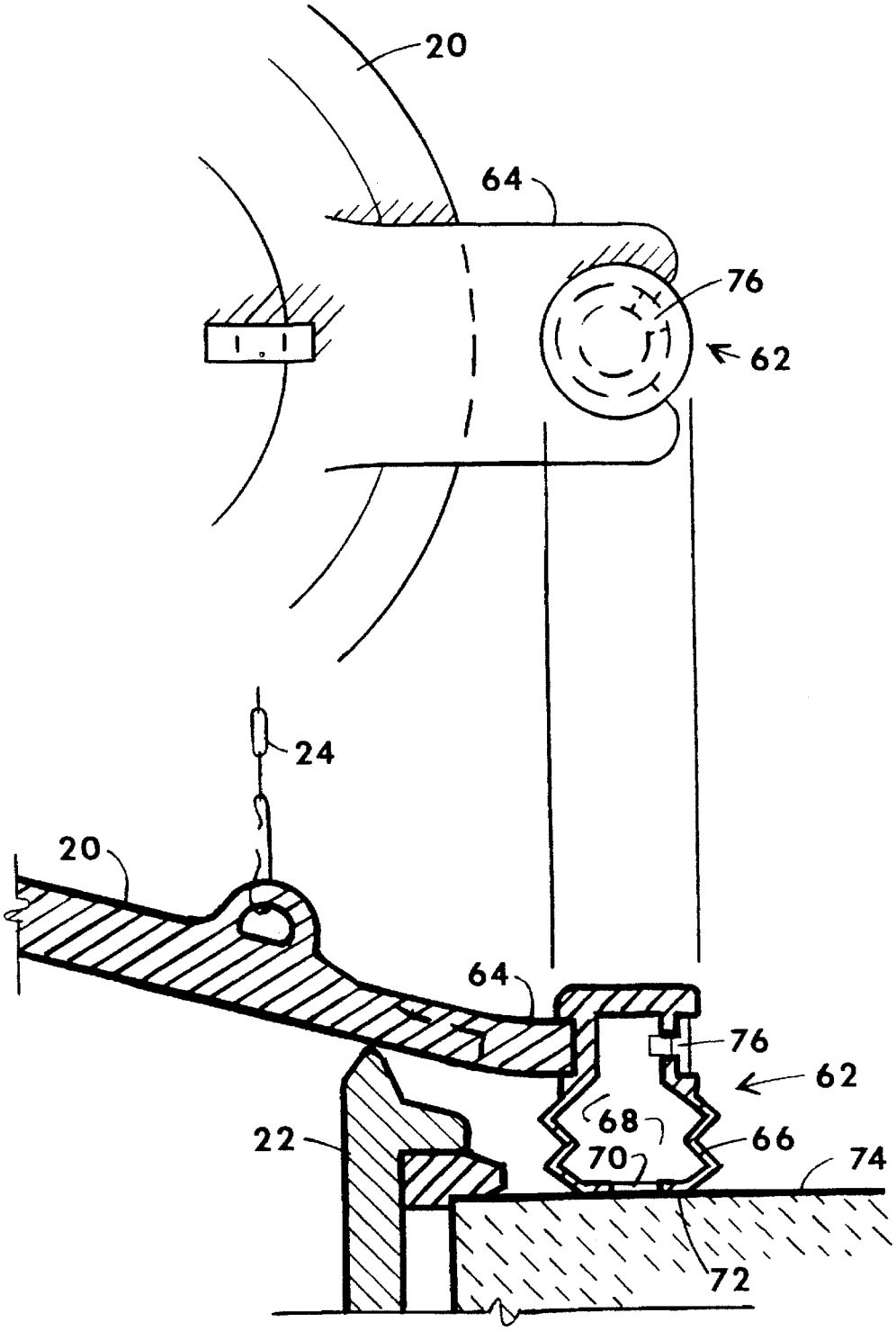
FIG. 4 is a detail of an open-ended, bellows type valve delayer.

A valve delayer 62 is fastened to valve 20 with a clevis 64 (FIG. 4) molded on valve 20. Valve delayer 62 is comprised of a bellows 66 made of flexible material such as rubber or vinyl around chamber 68. It is molded in its elongated position. It has an intake opening 70 in the lower end. A rim 72 around intake opening 70 presses against tank bottom 74 when valve 20 is nearly or completely closed. Bellows 66 has an expulsion hole 76 near the top. Expulsion hole 76 is slotted so that its size can be adjusted by rotating bellows 66 in clevis 64.

OPERATION OF THE PREFERRED EMBODIMENT

Depressing flush handle (not shown) raises first lift arm 26 (FIGS. 1 & 2) which pulls valve 20 open. Latch 52 prevents carriage 32 from floating up to its second position. Upper float 28 then holds valve 20 open in a near vertical position while water flows from the tank through outlet 22 When the water level drops to the level of the upper float 28, upper float 28 drops with it allowing valve 20 to nearly close. This stops the flushing action in the toilet bowl. Valve delayer 62 holds valve 20 slightly open for a few seconds to let some water flow under valve 20 through outlet 22 to completely refill the toilet bowl. A completely full toilet bowl helps in the effectiveness of the succeeding flush. After valve 20 closes, water pressure above it prevents upper float 28 from lifting it open. The tank refills, completing a short-duration flush that uses only about a half tank of water.

To achieve a longer flush, the user presses the flush handle down farther, which lifts valve 20 higher. This pulls carriage 32 up and disengages it from latch 52. The user can feel the resistance of latch 52 in the flush handle, which lets him know how far to depress the handle for the two different flushes. After disengagement, carriage 32 floats up to its second position (FIG. 3). After the upper float 28 drops, carriage 32 continues to hold valve 20 open. The effective weight of partially submerged valve 20 and carriage 32 overcome the buoyancy of lower floats 40. Valve 20 drops to a nearly closed position and pushes carriage 32 into its first position where it re-engages in latch 52. Delayer 62 holds valve 20 slightly open for a few seconds to refill the toilet bowl.

When valve 20 is closed or nearly closed there is no water under it providing upward pressure. Therefore the full weight of valve 20 and any water on it have enough leverage to overcome the buoyancy of lower floats 40. Also, lower floats 40 are positioned high enough that they are nearly out of the water when the water level is at lip of outlet 22. This prevents lower floats 40 from holding valve 20 partly open in a state of equilibrium.

The weight of delayer 62 on the end of valve 20 and relatively small lower floats 40 will cause valve 20 to start closing sooner. After it starts closing, water current catches it and causes it to close quickly. This is valuable on large tanks for saving some water during the longer flush cycle. For smaller tanks, small weights 50 can be added to counter balance valve 20. This will cause valve 20 to close later to nearly drain the tank and maximize its flushing capacity. Therefore, it will be understood that the lower floats 40 or small weights 50, or a combination thereof, comprise means for biasing the carriage 32 in an upward direction.

Latch 52 uses magnet 54 to hold carriage 32 at first position. Due to its leverage on frame 42, magnet 54 can be small and still produce enough resistance in the flush handle. It offers no resistance to re-engaging, which would prevent valve 20 from completely closing. Flexible connection 60 assures that magnet 54 will fully conjoin contact plate 56 without holding carriage 32 slightly too high which would prevent complete valve closing.

Valve delayer 62 contacts tank bottom 74 when valve 20 is nearly closed. Weight on the bellows 66 plus water pressure within it hold rim 72 against tank bottom 74 so that water cannot escape out intake opening 70. Water is forced out through expulsion hole 76. The size of expulsion hole 76 controls the rate of water flow through it, which controls how fast bellows 66 contracts. As bellows 66 contracts valve 20 closes completely. When valve 20 is opened, bellows 66 is lifted off tank bottom 74 and water enters through intake opening 70. Bellows 66 expands to an elongated condition due to its own weight and elasticity. The elasticity is small enough that it offers negligible resistance to complete closing of valve 20. Also, water will exit through expulsion hole 76 even under the slightest pressure so that valve 20 will always close. Delayer 62 can be used by itself or in conjunction with the usual refill hose (not shown) to overflow tube 46. If tank bottom 74 is rough, leakage under rim 72 can be compensated for by adjusting the size of the expulsion hole 76.

ALTERNATE EMBODIMENTS—AIR CHAMBER VALVE

Figure 5:
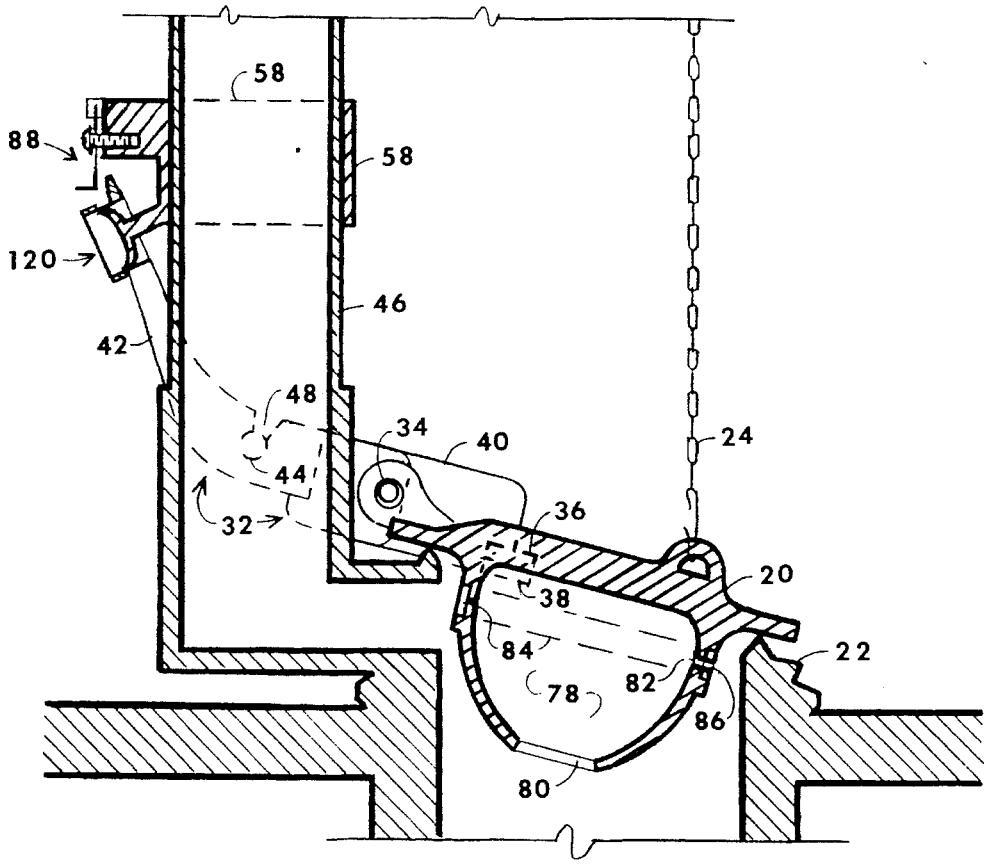
FIG. 5 is a section through an alternate valve with an air chamber, a spring latch, and a cup-type valve delayer.

FIG. 5 shows valve 20 with an air chamber 78 on the bottom side. Air chamber 78 has an opening 80 in the bottom of it and a release hole 82 in the side of it near the top. Release hole 82 is slotted horizontally. An adjustment band 84 wraps around air chamber 78 and has a slotted adjustment hole 86 in it. By rotating adjustment band 84, adjustment hole 86 can be moved over release hole 82 to adjust its size. Pull cord 24 does not have an upper float 28 attached to it.

After valve 20 is pulled open, it floats due to air in the air chamber 78. Air bubbles out through release hole 82 and water enters opening 80 until it becomes non-buoyant. The size of release hole 82 controls the rate at which air escapes so that valve 20 closes when the flush tank is about half empty.

ALTERNATE EMBODIMENTS—LATCHES

A number of different types of latches 52 are possible. They must provide resistance felt in the flush handle comparable to the resistance felt when valve 20 is opened against the water pressure. Otherwise the user will depress the handle too far for the short flush. They must also require negligible force for re-engagement, so that valve 20 does not stick open.

Figure 6:
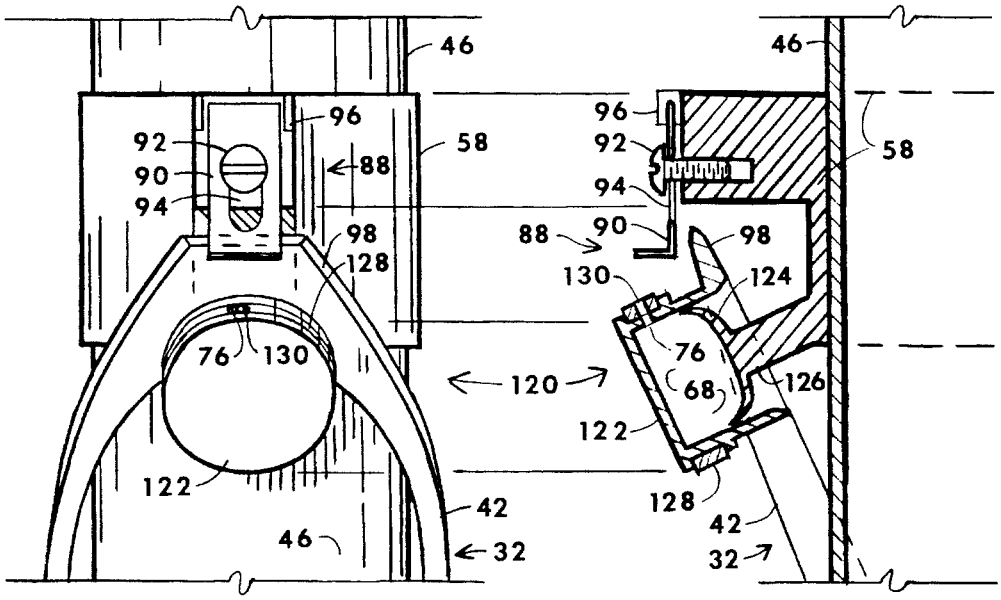
FIG. 6 is a detail of an alternate cup-type valve delayer.

FIGS. 5 & 6 show a spring latch 88. Spring 90 is made of non-corrosive metal such as stainless steel. It is loosely connected to cincture 58 by a non-corrosive screw 92 through a vertically slotted screw hole 94. Slotted screw hole 94 allows spring 90 to slide vertically. Spurs 96 prevent it from rotating. A projecting end 98 of carriage 32 contacts spring 90. It must bend spring 90 back to move by it, and thus disengage. To re-engage, it contacts the bottom of spring 90 and pushes it upward against only its gravitational weight and negligible friction. After projecting end 98 clears spring 90, spring 90 falls back into place. Screw 92 can adjust the force required for disengagement.

Figure 7:
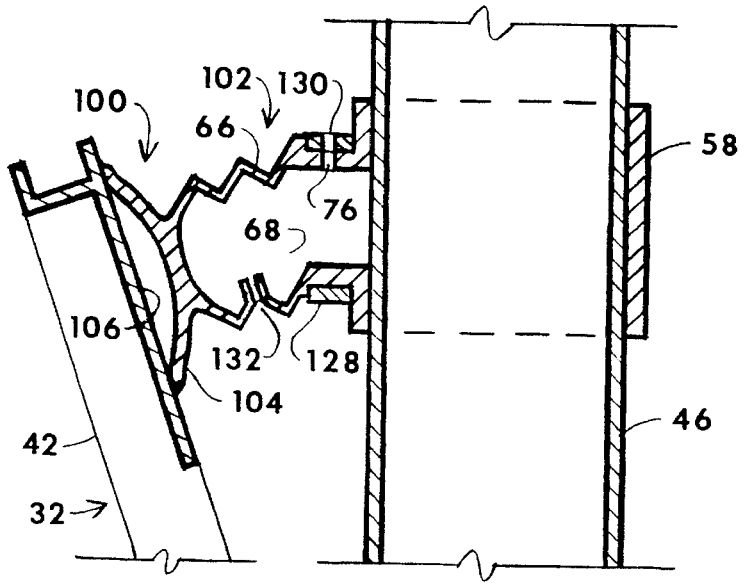
FIG. 7 is a detail of an alternate suction cup latch on the end of a bellows-type valve delayer.

FIG. 7 shows a suction cup latch 100 molded on the end of a valve delayer 102. It is comprised of a suction cup 104 of concave shape and flexible material. A flat surface 106 of carriage 32 contacts suction cup 104 and pushes air or water out of it. A vacuum between them resists disengagement. Water pressure causes the disengagement force to be greater than it would be in air.

Figure 9:
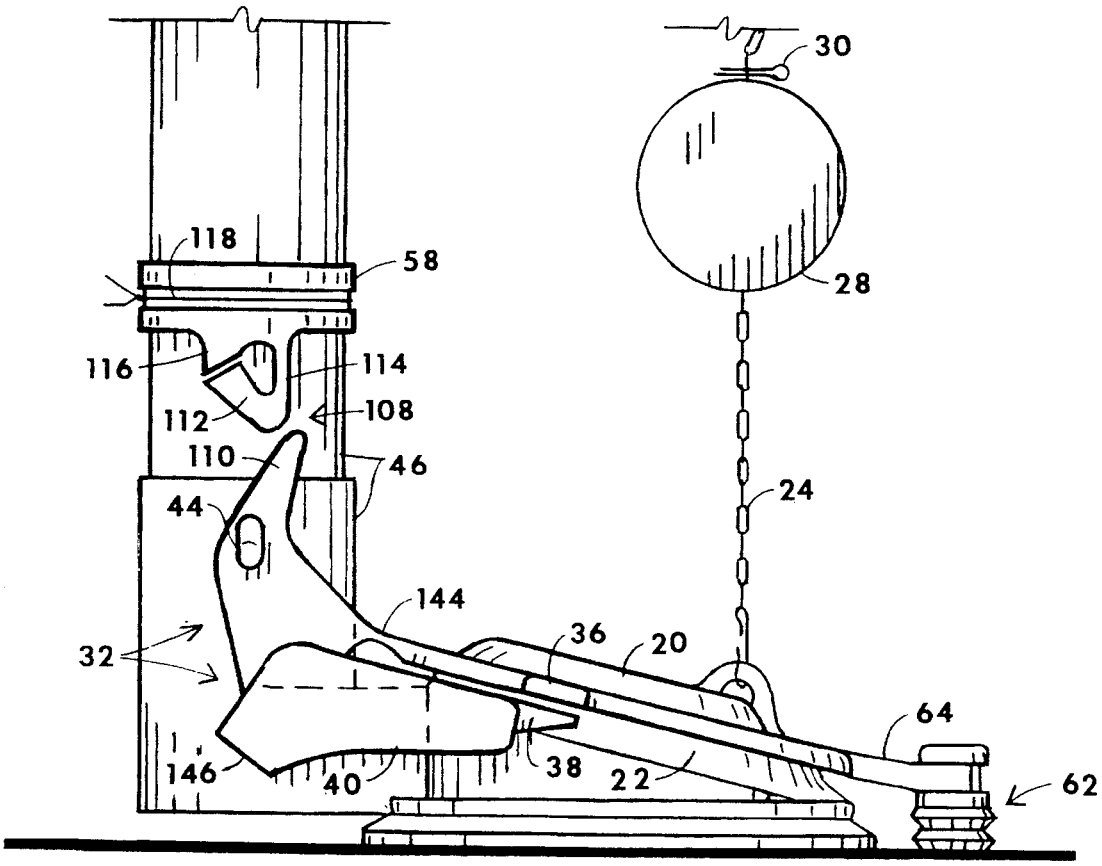
FIG. 9 is a side view of a one-piece valve and carriage alternate with an all-rubber latch.

FIG. 9 shows an all rubber or vinyl latch 108. A projecting finger 110 of carriage 32 contacts a keeper 112. A flexible neck 114 allows keeper 112 to rotate easily. A stop 116 prevents keeper 112 from rotating in one direction. A cinch wire 118 prevents cincture 58 from sliding. To disengage, projecting finger 110 bends under keeper 112 and compresses keeper 112 against stop 116. To re-engage, it only pushes against the minimal bending force of flexible neck 114 and the weight of keeper 112.

ALTERNATE EMBODIMENTS—VALVE DELAYERS

FIGS. 5 & 6 show a cup-type delayer 120. In this location it holds carriage 32 slightly above its first position which holds valve 20 slightly open. Spring latch 88 is positioned so that lower floats 40 can lift carriage 32 slightly up during the short duration flush.

Cup delayer 120 is comprised of a cylindrical cup 122 molded with carriage 32 and a plunger 124 forming chamber 68. Plunger 124 has a concave shape and is made of flexible material. A stem 126 connects it to cincture 58. Cup 122 has slotted expulsion hole 76 near its end. Adjustment band 128 can be rotated to position a slotted adjustment hole 130 over expulsion hole 76 to adjust its size.

When valve 20 opens, carriage 32 moves up causing the closed end of cup 122 to move away from plunger 124. Negative pressure within cup 122 bends the rim of plunger 124 inward and away from the sides of cup 122, creating a space for water to enter. When valve 20 closes, the closed end of cup 122 moves toward plunger 124. Inside pressure bends the rim of plunger 124 outwards against the sides of cup 122, preventing water from escaping. Water is forced out expulsion hole 76, controlling the rate at which valve 20 can close.

FIG. 7 shows valve delayer 102 similar to that of the main embodiment. Instead of being an intake opening 70, there is a slit 132 along the inside fold of bellows 66. The size of expulsion hole 76 is adjusted in the same way as it is for cup-type delayer 120 (FIG. 6). When valve 20 opens, the end of carriage 32 moves away from the overflow tube 46 causing bellows 66 to expand. Inside negative pressure and expansion of bellows 66 cause slit 132 to open allowing water to enter. As valve 20 closes, carriage 32 presses against suction cup 104 which compresses bellows 66. Inside pressure and compression of bellows 66 cause slit 132 to close preventing water from escaping. Water is forced out through expulsion hole 76 at a controlled rate.

Figure 8:
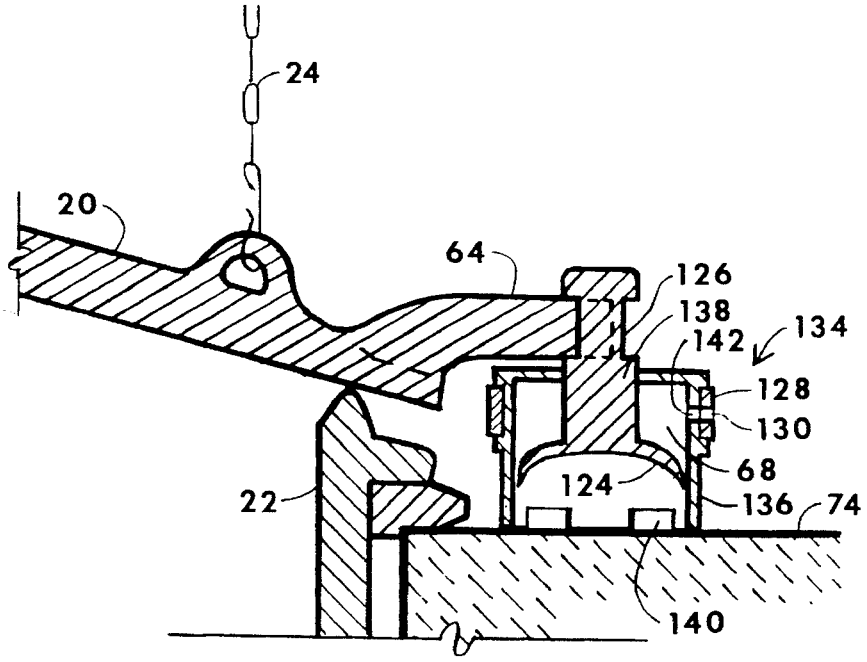
FIG. 8 is a detail of an alternate vacuum-type valve delayer.

FIG. 8 shows a vacuum type delayer 134. It is comprised of a vacuum cup 136 made of rigid material such as plastic. The closed end of the vacuum cup 136 has a stem opening 138 for stem 126 to pass through. Vacuum cup 136 has outlet openings 140 in the bottom and a suction hole 142 near the top. It operates in the same manner as cup-type delayer 120 (FIG. 6) except that a vacuum is created in chamber 68 as valve 20 closes. The rate that it closes is controlled by the rate that water can enter through suction hole 142.

ALTERNATE EMBODIMENTS—CARRIAGES

FIG. 9 shows an even less expensive embodiment. Carriage 32 and lower float 40 on both sides of overflow tube 46 are molded together in one piece with valve 20. They are made of flexible material. A hinge 144 is created by a thin section molded between valve 20 and carriage 32. A float opening 146 for molding lower floats 40 is located so that air will remain trapped within. Some air can be squeezed out to adjust the buoyancy so that valve 20 will close earlier during the longer flush cycle. Operation is the same as for the above embodiments.

Figure 10:
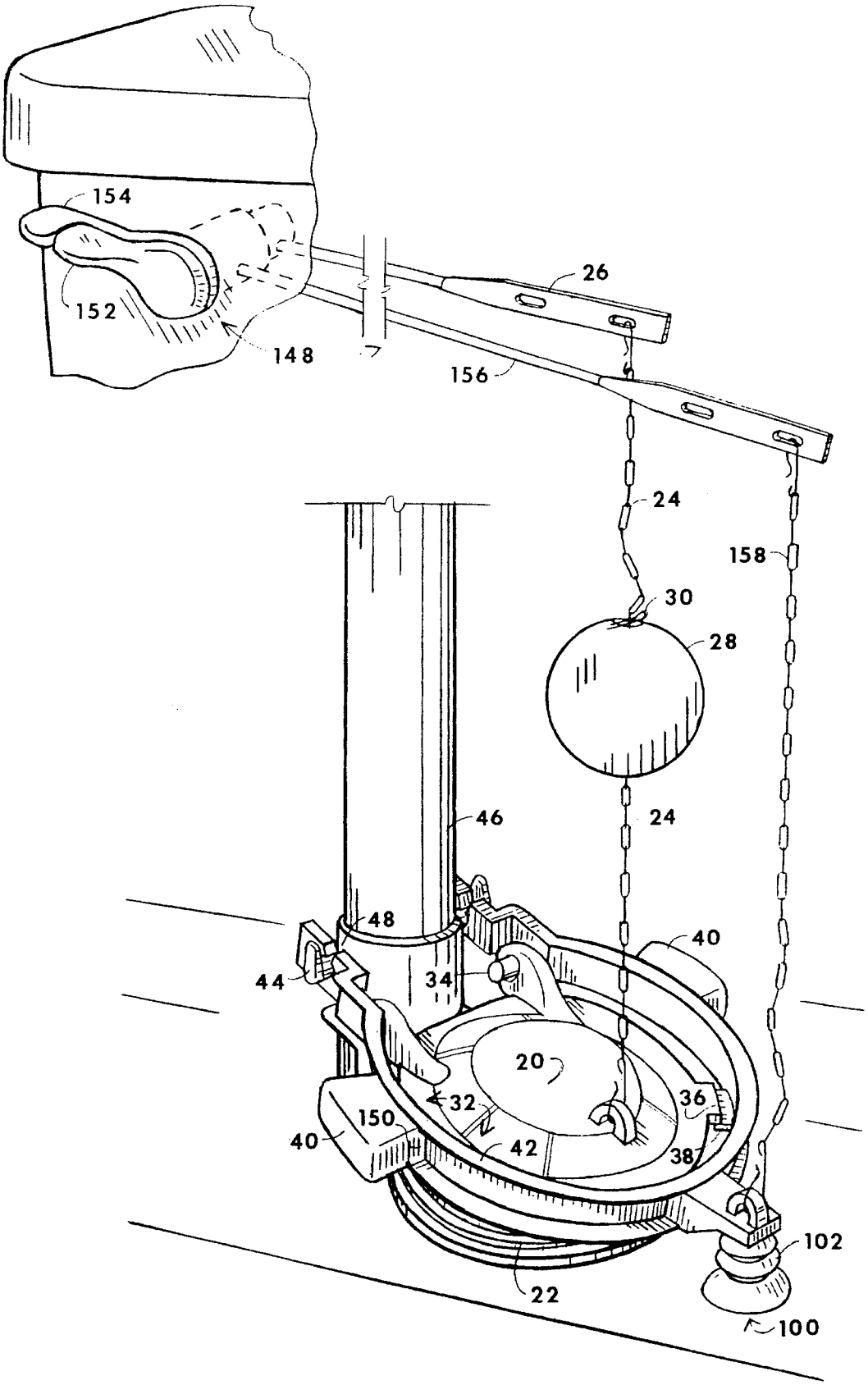
FIG. 10 is a three-dimensional view of a ring carriage alternate with optional dual handles.

FIG. 10 shows a more versatile embodiment. It can be mounted on either a flat or sloping outlet 22. It can be attached to a single first lift arm 26 as in the above embodiments or used with a dual handle system 148 as shown.

Frame 42 of carriage 32 encircles valve 20. Lower floats have inserts 150 which fit into the C-shaped cross section of frame 42 Their location can be changed to adjust when valve 20 closes during the longer flush cycle. Valve delayer 102 with suction cup latch 100 attaches to frame 42.

A first handle 152 and a second handle 154 are concentric and attach directly and respectively to first lift arm 26 and a second lift arm 156. Upward and downward movement of first and second lift arms 26 & 156 are limited in the same manner as in a conventional flush handle. A second pull cord 158 connects second lift arm 156 to carriage 32. Pull cords 24 and 158 are smooth to avoid catching and entangling with one another.

When used with a single flush handle, operation is the same as above. When used with dual handle system 148 the short duration flush is actuated by pressing first handle 152. This opens valve 20 and upper float 28 holds it open until the tank is about half empty. To actuate the longer flush, second handle 154 is pressed, which lifts carriage 32 and opens valve 20. Carriage 32 holds valve 20 open until the tank is nearly empty.

It should be noted that the longer flush can also be actuated by pressing first handle 152 farther down. This possibility can be eliminated, if desired, by putting more slack in first pull cord 24 and limiting the upward movement of first lift arm 26. It can also be eliminated by connecting valve 20 to carriage 32 at the same location that carriage 32 mounts on the overflow tube 46.

CONCLUSION, RAMIFICATIONS, AND SCOPE OF INVENTION

Thus the objects and advantages cited above have clearly been met by this invention as follows:

- The short flush can be adjusted to the optimum level for each particular toilet by adjusting the height of upper float 28. It will save over half a tank of water, and still leave clean water in the bowl. Because the short flush will be used most of the time, it can reduce water bills significantly for both residential and business installations. If used by a large segment of the public, this device will reduce the need for new, expensive water supply facilities and ease the demand on rivers, streams, and wetlands.
- The long flush allows solid waste to be flushed out without requiring a second flush or leaving dirt in the toilet bowl. On large tanks, this device can be adjusted to close sooner, so that the long flush also saves some water. On toilets with small tanks that sometimes have problems, it can be adjusted to nearly drain the tank.
- Unlike most previous two-level systems, this one provides for complete refill of the toilet bowl. The refill can be adjusted for each particular toilet. A full toilet bowl looks better and helps in the next flush. The refill device can also be used on single-level systems.
- This device fits on the vast majority of overflow tubes and outlets in use, which are as shown on the drawings. No additional supports or adaptations are needed. It also works in toilets where side handles or push buttons raise the lift arm.
- This device is easy to install because it only replaces the flapper valve and pull cord. It can be done so quickly that there is hardly any need to turn off the water supply.
- This device can fit into a package as small as 1.5"×4"×5.5". This allows for easy handling, shipping, and displaying.
- This two-level valve has very few parts, and they are molded of plastic and rubber. It can easily be assembled. It is inexpensive.
- Even though simple, this device is designed against all the problems that can cause it to malfunction, as explained in the operations section above.
- This two-level valve is easy to use. It is similar to flushing a conventional toilet. A second resistance felt in the handle lets the user know how far to depress it. An attractive decal can be placed under the handle to show or remind users of the two levels.
- The dual-handle variation can add a touch of class to a bathroom, and make the two levels obvious.

The above description contains many specific items, but these should not be construed to limit the scope of this invention. They are only examples of some preferred embodiments. Many other variations are possible. For example:

- The various types of latches and delayers described can be placed in different locations in many different combinations.
- The delayers can be located between tabs 13 and tabs 14 (FIGS. 1 & 2), or located under the lower level floats 40.
- Latches can be adhesively mounted on the tank bottom under carriage 32.
- Other latches are possible, as long as they give sufficient resistance for disengagement to be felt in the flush handle, and require very little force to re-engage.

Upper float 28 can have various shapes and does not have to center on pull cord 24. It is shown spherical so that pull cord 24 will not entangle around it.

The ring-shaped carriage (FIG. 10) could be comprised of a hollow tube around valve 20, forming a floating frame.

A timing cup may be attached to the carriage 32 (FIG. 1 & 2) on the end opposite valve 20. The weight of water in a timing cup holds valve 20 open a few seconds longer until the water drains out through holes in the bottom of the cup.

For unusual toilets, where the lift arm does not raise high enough to pull the carriage out of the latch, an extension can be connected to the lift arm.

Some toilets have had mounting pins located on the side of outlet 22, adjacent overflow tube 46. An asymmetrical carriage could be made to wrap around just one side of valve 20 to avoid interference with overflow tube 46.

Therefore the scope of this invention should be determined by the following claims and their legal equivalent, rather than by the examples given.

I claim:

1. A flush valve assembly for a flush tank having an outlet and a first flush handle connected to a first lift arm, said flush valve assembly comprising a) a carriage rotatably connectable along a fixed axis in said flush tank so that it can rotate between a first position adjacent said outlet and a second position above said outlet, said carriage including a frame having means for biasing said carriage upwardly, b) a valve adapted to seat on said outlet in a closed position, said valve having a rotatable connection to said carriage, said valve connected to a first pull cord which is connectable to said first lift arm for lifting said valve to an open position, c) support means for supporting said valve relative to said carriage such that said valve rotation is limited in a downward direction, d) latching means to hold said carriage in said first position, said latching means being disengaged when subject to a predetermined force, and e) sustaining means to maintain said valve in said open position for a predetermined amount of time, which is less than the time needed to substantially drain said flush tank whereby depressing said first flush handle a predetermined first amount opens said valve, said latching means preventing said carriage from rising to said second position, and said latching means also providing a resistance in said first flush handle to define said first amount, and further depression of said first flush handle through said resistance lifts said valve and disengages said latching means allowing said carriage to rise to said second position where said carriage holds said valve open for an amount of time longer than said predetermined amount of time.

2. The flush valve assembly of claim 1, wherein said sustaining means is an upper float attached to said first pull cord between said valve and said first lift arm, whereby said upper float holds said valve open until water drops to the level of said upper float, allowing said upper float to drop with the water level which allows said valve to close.

3. The flush valve assembly of claim 1, wherein said sustaining means is an air chamber in a bottom side of said valve, said air chamber having an opening through a bottom thereof and a release hole of predetermined size through a top side portion thereof, whereby air will escape through said release hole at a predetermined rate when said valve is open.

4. The flush valve assembly of claim 3, further including means for adjusting the rate at which air escapes through said release hole.

5. The flush valve assembly of claim 1, wherein said latching means comprises a magnet and a metal contact plate, one connectable to part of said flush tank and the other connected to said carriage.

6. The flush valve assembly of claim 1, wherein said latching means is comprised of a projecting end of said carriage and a spring attachable to a fixed part of said flush tank.

7. The flush valve assembly of claim 1, wherein said latching means is comprised of a suction cup of concave shape and flexible material, and a flat surface, one connectable to part of said flush tank and the other connected to said carriage.

8. The flush valve of claim 1, wherein said latching means is comprised of a projecting finger of said carriage, a keeper fastenable to part of said flush tank by a flexible neck that bends easily, and a stop connectable to part of said flush tank to resist said keeper from bending in one direction.

9. The flush valve assembly of claim 1, further including delayer means for holding said valve slightly open for a short, predetermined amount of time before closing, whereby a predetermined amount of water flows under said valve into said outlet to refill the toilet bowl.

10. The flush valve assembly of claim 1, further including delayer means for stopping said carriage slightly above said first position and causing it to move from slightly above said first position to said first position at a predetermined rate, whereby said carriage holds said valve slightly open for a predetermined time to allow water to flow under it into said outlet to refill the toilet bowl.

11. The flush valve assembly of claim 1, wherein said valve and said carriage are molded in one piece, having a thin section between them which provides said rotatable connection between said valve and said carriage.

12. The flush valve assembly of claim 1, further including a second flush handle adapted to be mounted concentric with said first flush handle, a second lift arm rigidly connected to said second flush handle, a second pull cord having one end connected to said second lift arm and the other end connected to said carriage, whereby pressing said first flush handle lifts said valve to produce a short flush, and pressing said second flush handle lifts said carriage which lifts said valve to produce a longer flush.

* * * * *